United States Patent [19]

DeMars

[11] Patent Number: 4,601,671

[45] Date of Patent: Jul. 22, 1986

[54] HUGGABLE TOY MECHANISM

[76] Inventor: Robert DeMars, 7932 Maestro Ave., Canoga Park, Calif. 91304

[21] Appl. No.: 733,896

[22] Filed: May 14, 1985

[51] Int. Cl.[4] ..... A63H 3/20

[52] U.S. Cl. ..... 446/330

[58] Field of Search ..... 446/330, 365, 359, 188, 446/354, 379, 376, 331, 336, 370, 371, 375, 369

[56] References Cited

U.S. PATENT DOCUMENTS

| | | | |
|---|---|---|---|
| 1,800,775 | 4/1931 | Bostwick | 446/336 |
| 2,901,862 | 9/1959 | Thomas | 446/354 X |
| 3,053,008 | 9/1962 | Pelunis | 446/330 |
| 4,258,498 | 3/1981 | Aughey | 446/188 |

FOREIGN PATENT DOCUMENTS

| | | | |
|---|---|---|---|
| 1601180 | 10/1981 | United Kingdom | 446/330 |

*Primary Examiner*—Mickey Yu

*Attorney, Agent, or Firm*—Cislo, O'Reilly & Thomas

[57] ABSTRACT

A toy, such as a bear, having movable appendages is provided with a huggable mechanism that, upon squeezing of the toy causes the appendages to simulate a hugging motion. The huggable mechanism comprises two spaced apart parallel plates maintained in position by a resilient material and hingedly positioned members extending from the plates.

8 Claims, 5 Drawing Figures

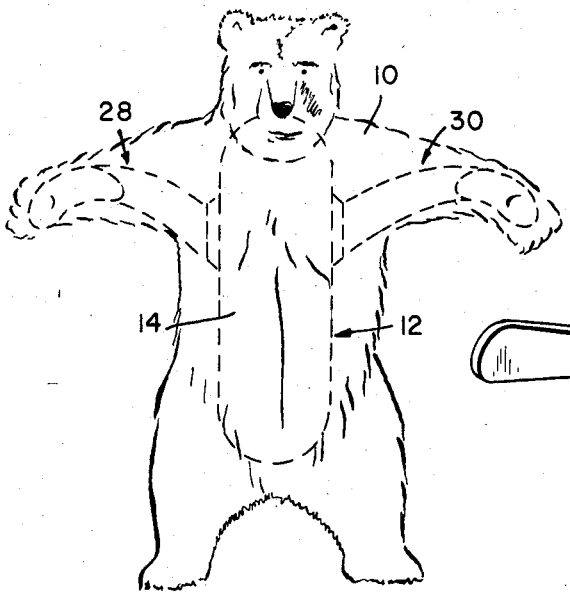
Fig. 1.
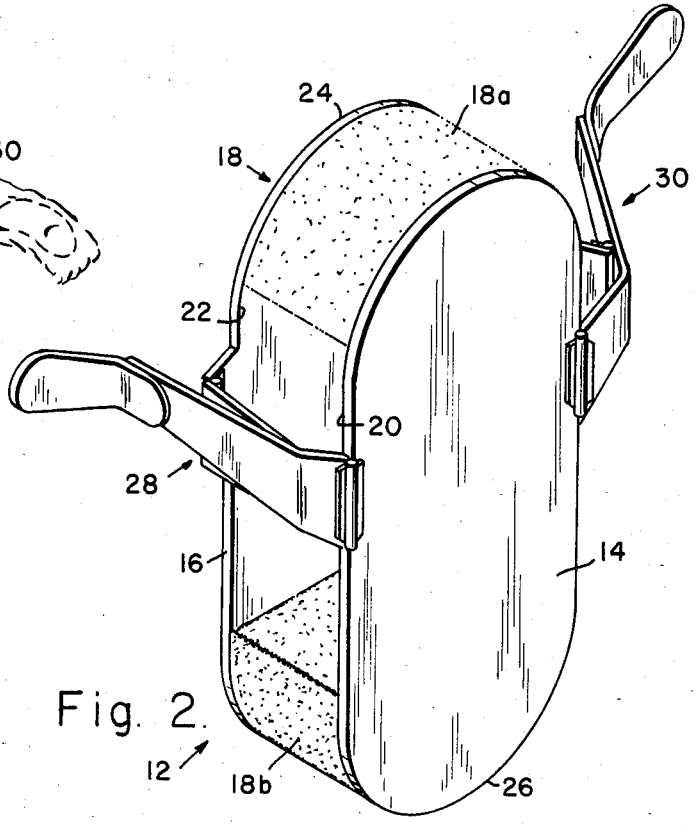
Fig. 2.
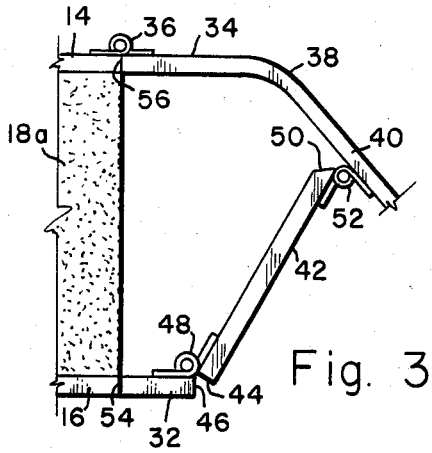
Fig. 3.
Fig. 5.
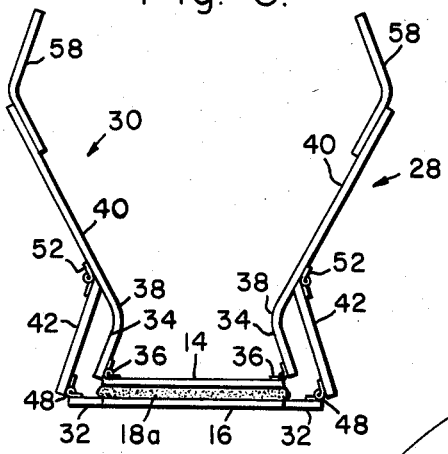
Fig. 4.
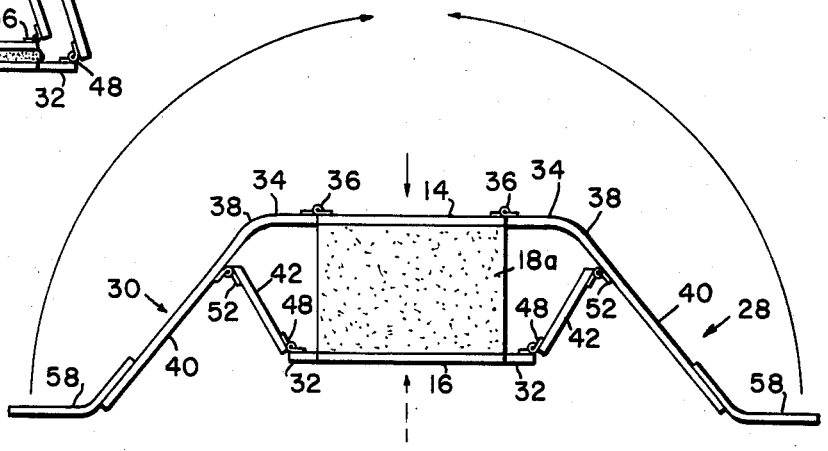

HUGGABLE TOY MECHANISM

BACKGROUND OF THE INVENTION

This invention relates to toys, and, more particularly, to a huggable toy mechanism, especially suitable for a toy bear.

It is well-known that the act of hugging provides necessary emotional nurishment for people of all ages. In particular, it is well-known that children deprived of physical attention, such as hugging, by loved ones often develop psychological problems later in life. On the other hand, even physical attention by surrogates is helpful.

It is with this awareness—that all children can use a hug—that the present invention was developed.

OBJECTS AND SUMMARY OF THE INVENTION

It is an object of the present invention to provide a mechanism for a toy that simulates a hugging action.

It is another object of the present invention to provide a huggable toy mechanism, particularly for a toy bear.

These and further objects of the invention will become apparent from the hereinafter following commentary taken in conjunction with the drawing.

In accordance with the invention, a huggable toy mechanism is provided. The mechanism comprises a pair of substantially parallel plates, a resilient means separating the parallel plates, and hingedly positioned members extending from the plates and adapted to move pivotally forward in a hugging action when the parallel plates are squeezed together.

BRIEF DESCRIPTION OF THE DRAWING

FIG. 1 depicts a toy bear, with the huggable mechanism of the invention shown in phantom;

FIG. 2 is a three-dimensional view of the huggable mechanism of the invention;

FIG. 3 is a detail of a portion of FIG. 2, showing the interrelationship of the hinged members employed in the huggable mechanism;

FIG. 4 is a top plan view of the huggable mechanism in the open, or usual, position; and FIG. 5 is a top plan view of the huggable mechanism in the closed, or hugging, position.

DETAILED DESCRIPTION OF THE PREFERRED EMBODIMENTS referring now to the drawing wherein like numerals of reference designate like elements throughout, a toy is shown, here, a toy bear, with the huggable mechanism 12 of the invention, which is interior the toy 10, shown in phantom lines. It will be appreciated that other three-dimensional toys, whether of animals, anthropomorphized animals or humanoids, may be suitably employed in the practice of the invention. FIG. 2 depicts in greater detail the huggable mechanism 12, which comprises a pair of substantially parallel plates 14, 16 separated by a resilient means 18, which is attached to a major surface 20, 22 of each plate 14, 16, respectively. The resilient means maintains the parallel plates 14, 16 in substantially parallel spaced apart position. The resilient means 18, however, also yields to permit movement of the two plates 14, 16 together, to actuate the hugging motion, as described below.

Preferable, the plates 14, 16 are elongated, with the long axis of the plates to be aligned with the long axis of the toy. While the resilient means 18 may comprise one piece of resilient material, of suitable size to maintain the two parallel plates 14, 16 in spaced, parallel position, preferably, two pieces of resilient material 18*a*, 18*b* are employed, most preferably positioned at the upper and lower portions, 24 and 26, respectively, of the hugging mechanism, as defined by the long axis of the plates 14, 16.

The plates 14, 16 comprise any hard material that is easily formed into thin plates. Examples include metal, plastics such as methyl methacrylate (Plexiglas), polycarbonate (Lexan) and the like, and wood. The resilient means 18 comprises conventional resilient materials such as sponge rubber, foam rubber, and the like. The resilient means 18 is conveniently attached to a major surface 20, 22 of each plate 14, 16, respectively, by means of a suitable adhesive.

A pair of hingedly extending members 28, 30 are attached to the plates 14, 16. Each member comprises three segments: a first short segment 32 extending laterally from the back plate 16 and rigidly attached thereto; a second longer segment 34 hingedly attached to the front plate 14 by a hinge means 36 and provided with a bend 38 which orients the extended portion 40 of the second segment 26 in the direction of the back plate 16; and a third segment 42 of intermediate length, hingedly attached at one end 44 to the extended end 46 of the first segment 32 by a hinge means 48 and at the other end 50 to the extended portion 40 of the second segment 34 by a hinge means 52.

The first segment 32 extends laterally from the back plate 16 in the same plane as the plate. One end 54 of the first segment 32 may be bonded to the back plate 16, as with an adhesive in the case of plastic or wood plates and segments, with a weld joint or brazed joint or similar bond in the case of metal plates and segments, or in other suitable fashion. Alternatively, the first segment 32 may be fabricated as a part of the back plate 16.

One end 56 of the second segment 34 is hingedly attached to the front plate 14 by hinge means 36 such that in the open position, shown in FIG. 4, the attached end of the second segment is in the same plane as the plate 16 and hence substantially parallel to the first segment 32. In addition to the bend 38 and extended portion 40, the second segment 26 is also provided with a curved extension 58, which is substantially parallel to the plane of the first segment 32. The portion 40 following the bend 38 corresponds with the "arms" of the toy, while the curved extension 58 corresponds with its "hands" or "paws". The curved extention 58 may be attached at or near the end of bent portion 40 of segment 34 by any suitable means, as described above for the first segment 32 and the back plate 16, or may be a continuation of the bent portion 40, also suitably bent.

The length of the third segment 42 is fixed by the extent of the bend establishing the bent portion 40. It will be appreciated that the end 50 of the third segment 42 attached to the hinge means 52 is beveled at an angle so that in the closed position, shown in FIG. 5, the end 50 will not interfere with the closing or hugging motion.

The operation of the huggable mechanism derives from pressing on the front plate 14 while supporting the back plate 16. As seen in FIGS. 4 and 5, the appropriate pressure causes the third segment 34 to move in the direction of the front plate 14 and thus simulate a "hugging" action. Thus, a stuffed toy, such as a bear, having movable appendages is provided with the huggable mechanism of the invention in a manner that upon squeezing the toy, the appendages are caused to move in the manner described herein by the movement of the hingedly attached extending members.

It will be appreciated that for a given set of parameters for the hingedly attached extending members 28, 30 (length, angle of bend, and the like), the distance separating the plates 14, 16 may be suitably adjusted by changing the thickness of the resilient means 18. These changes require only simple experimentation to derive the optimum conditions for the hugging action.

Thus, there has been disclosed a huggable toy mechanism for use in toys to simulate a hugging motion. Various modifications and changes will make themselves available to those of ordinary skill in the art, and all such changes and variances not deviating from the spirit and essence of the invention are intended to be covered by the appended claims.

What is claimed is:

1. A huggable toy mechanism for placement in a toy comprising:

(a) a pair of spaced apart substantially parallel plates, forming a front plate and a back plate;

(b) resilient means between said plates, supporting said plates in a substantially parallel configuration; and (c) hingedly positioned members extending from said plates and adapted to move pivotally forward in a hugging motion when said plates are squeezed together, said hingedly positioned members comprising three segments:

(1) a first segment extending laterally from said back plate, rigidly attached thereto and having a relatively short length, (2) a second segment hingedly attached to said front plate by a first hinge means and including a first portion bent forward toward said back plate and a second bent portion substantially parallel to the plane of said first segment, and (3) a third segment hingedly attached at one end to said first segment by a second hinge means and at the other end to said first bent portion of said second segment by a third hinge means.

2. The huggable toy mechanism of claim 1 wherein said plates are elongated, thereby establishing an axis in the elongated direction, and defining an upper and lower portion of each plate, said toy also being elongated, thereby establishing an axis in the elongated direction, with said elongated axis of said plate and said elongated axis of said toy adapted to be aligned substantially parallel to each other.

3. The huggable toy mechanism of claim 2 wherein said plates are separated by two pieces of resilient material, located on the major surface of each plate, near the upper and lower portions of said plates.

4. The huggable toy mechanism of claim 1 wherein said resilient means comprises a sponge or foam rubber.

5. The huggable toy mechanism of claim 1 wherein the end of said third segment attached to said second segment by said third hinge means is beveled at an angle to accommodate the movement of said second segment upon application of pressure to said plates.

6. A huggable toy mechanism for placement in a toy having movable appendages comprising:

(a) a pair of spaced apart substantially parallel plates, forming a front plate and a back plate;

(b) resilient means between said plates, supporting said plates in substantially parallel configuration; and (c) hingedly positioned members extending from said plates, said hingedly position members comprising three segments:

(1) a first segment extending laterally from said back plate, rigidly attached thereto and having a relatively short length, (2) a second segment hingedly attached to said front plate by a first hinge means and including a first portion bent toward said back plate and a second bent portion substantially parallel to said first segment, and (3) a third segment hingedly attached at one end to said first segment by a second hinge means and at the other end to said second segment by a third hinge means, whereupon pressing said plates together causes said hingedly positioned members to simulate a hugging motion.

7. In combination, a toy provided with movable appendages and a huggable mechanism interior the toy adapted to move the appendages, the huggable mechanism comprising:

(a) a pair of spaced apart substantially parallel plates, forming a front plate and a back plate;

(b) resilient means between said plates, supporting said plates in substantially parallel configuration; and (c) hingedly positioned members extending from said plates and adapted to move pivotally forward in a hugging motion when said plates are squeezed together, said members positioned within said appendages, said hingedly positioned members comprising three segments:

(1) a first segment extending laterally from said back plate, rigidly attached thereto and having a relatively short length, (2) a second segment hingedly attached to said first plate by a first hinge means and including a first portion bent toward said back plate and a second bent portion substantially parallel to the plane of said first segment, and (3) a third segment hingedly attached at one end to said first segment by a second hinge means and at the other end to said first bent portion of said second segment by a third hinge means.

8. The combination of claim 7 wherein said resilient means comprises a sponge or foam rubber.

* * * * *